US008575488B2

(12) United States Patent
Sugiyama et al.

(10) Patent No.: US 8,575,488 B2
(45) Date of Patent: Nov. 5, 2013

(54) DIFFERENTIAL SIGNAL TRANSMISSION CABLE

(75) Inventors: Takahiro Sugiyama, Hitachi (JP); Hideki Nonen, Hitachi (JP); Takashi Kumakura, Hitachinaka (JP)

(73) Assignee: Hitachi Cable, Ltd., Tokyo (JP)

( * ) Notice: Subject to any disclaimer, the term of this patent is extended or adjusted under 35 U.S.C. 154(b) by 173 days.

(21) Appl. No.: 13/137,993

(22) Filed: Sep. 23, 2011

(65) Prior Publication Data

US 2012/0186850 A1 Jul. 26, 2012

(30) Foreign Application Priority Data

Jan. 24, 2011 (JP) ..... 2011-011708
Sep. 9, 2011 (JP) ..... 2011-196737

(51) Int. Cl.
*H01B 11/06* (2006.01)

(52) U.S. Cl.
USPC ..... 174/105 R; 174/102 R; 174/113 R; 174/116

(58) Field of Classification Search
USPC ..... 174/102 R, 105 R, 113 R, 117 F, 116
See application file for complete search history.

(56) References Cited

U.S. PATENT DOCUMENTS 6,037,545 A * 3/2000 Fox et al. ..... 174/110 R
6,403,887 B1 6/2002 Kebabjian et al.
6,504,379 B1 1/2003 Jackson
6,740,808 B1 * 5/2004 Chang ..... 174/36
7,790,981 B2 9/2010 Vaupotic et al.
2004/0026101 A1 2/2004 Ochi
2006/0054334 A1 * 3/2006 Vaupotic et al. ..... 174/36
2008/0105449 A1 * 5/2008 Kenny et al. ..... 174/34
2009/0260847 A1 * 10/2009 Tobben et al. ..... 174/107
2011/0139485 A1 * 6/2011 Matsuda et al. ..... 174/102 R
2011/0315419 A1 * 12/2011 Grant et al. ..... 174/34

FOREIGN PATENT DOCUMENTS

JP 2001-035270 A 2/2001
JP 2001035270 A * 2/2001
JP 2002-289047 A 10/2002
JP 2003-297154 A 10/2003
JP 2008-226564 A 9/2008

* cited by examiner

*Primary Examiner* — Timothy Thompson
*Assistant Examiner* — Amol Patel
(74) *Attorney, Agent, or Firm* — McGinn IP Law Group, PLLC

(57) ABSTRACT

A differential signal transmission cable has a pair of conductors arranged to be distant from each other and parallel to each other, an insulator covering the pair of conductors, and a shield conductor wound around the insulator. The insulator has an outer periphery shape of a transversal cross section in that a plurality of curved lines with different curvature radiuses are combined. The shield conductor has an inner periphery shape of a transversal cross section in that the plurality of curved lines are combined in accordance with the outer periphery shape of the insulator.

20 Claims, 7 Drawing Sheets

DIFFERENTIAL SIGNAL TRANSMISSION CABLE

The present application is based on Japanese patent application No. 2011-011708 filed on Jan. 24, 2011 and Japanese patent application No. 2011-196737 filed on Sep. 9, 2011, the entire contents of which are incorporated herein by reference.

BACKGROUND OF THE INVENTION

1. Field of the Invention

The present invention relates to a differential signal transmission cable.

2. Description of the Related Art

As one example of conventional differential signal transmission cables, Japanese Patent Laid-Open No. 2002-289047 (JP-A 2002-289047) discloses a parallel twin-core shielded electric wire, in which a pair of insulated electric wires are arranged in parallel, at least one drain conductor is arranged in parallel with the insulated electric wires, the pair of insulated electric wires and the drain conductor are wound up collectively with a metal foil tape as a shield conductor, and an outer periphery part of this shield conductor is covered with a jacket.

According to the parallel twin-core shielded electric wire disclosed by JP-A 2002-289047, it is possible to shorten a time for manufacturing, since the shield conductor is formed by winding a metal foil tape.

SUMMARY OF THE INVENTION

However, in the parallel twin-core shielded electric wire disclosed by JP-A 2002-289047, the metal foil tape has a flat portion in its cross section in a transverse direction. In this flat portion, a direction of a tensile force of the metal foil tape is parallel to a direction made by a surface of the flat portion, so that a pressure for pushing the metal foil tape based on the tensile force of the metal foil tape does not occur. As a result, there is a slack in the metal foil tape, i.e. the metal foil tape tends to be released. In the conventional parallel twin-core shielded electric wire, there is a disadvantage in that skew and differential mode to common mode conversion amount are increased due to the slacks of the metal foil tape.

Accordingly, it is an object of the invention to provide a differential signal transmission cable by which the skew and differential mode to common mode conversion amount can be suppressed.

According to a feature of the invention, a differential signal transmission cable comprises:

a pair of conductors arranged to be distant from each other and parallel to each other;

an insulator covering the pair of conductors, the insulator having an outer periphery shape of a transversal cross section in that a plurality of curved lines with different curvature radiuses are combined; and a shield conductor wound around the insulator, the shield conductor having an inner periphery shape of a transversal cross section in that the plurality of curved lines are combined in accordance with the outer periphery shape of the insulator.

In the differential signal transmission cable, a minimum value of the curvature radiuses of the plurality of curved lines is preferably 1/20 or more and 1/4 or less of a maximum value of the curvature radiuses of the plurality of curved lines.

In the differential signal transmission cable, the outer periphery shape of the transversal cross section of the insulator may comprise an elliptical shape, and a minor axis of the transversal cross section is preferably 0.37 times or more and 0.63 times or less of a major axis of the transversal cross section.

The differential signal transmission cable may further comprise a jacket member coating the shield conductor, in which the shield conductor may comprise an insulating member and an electrically conductive film provided on the insulating member at a surface facing to the jacket member.

In the differential signal transmission cable, the shield conductor may comprise a seam or an overlapping region along a longitudinal direction of the insulator, and the jacket member may comprise a seam or an overlapping region spirally on the shield conductor.

In the differential signal transmission cable, the shield conductor may comprise a seam or an overlapping region on the insulator, and the jacket member may comprise a braid.

In the differential signal transmission cable, the insulator may comprise a foam material.

In the differential signal transmission cable, the insulator may comprise an outer layer having a foaming degree smaller than a foaming degree of a portion interior to the outer layer.

Points of the Invention

In the present invention, an insulator has an outer periphery shape of a transversal cross section in that a plurality of curved lines with different curvature radiuses are combined, and a shield conductor has an inner periphery shape of a transversal cross section in that the plurality of curved lines are combined in accordance with the outer periphery shape of the insulator.

According to the differential signal transmission cable of the present invention, it is possible to suppress the skew and the differential mode to common mode conversion amount.

BRIEF DESCRIPTION OF THE DRAWINGS

The embodiments according to the invention will be explained below referring to the drawings, wherein:

FIGS. 2A and 2B are schematic diagrams of the differential signal transmission cable in the first embodiment, wherein FIG. 2A is a cross sectional view of the differential signal transmission cable taken along a transverse direction, and FIG. 2B is a schematic diagram of a cross section of the differential signal transmission cable cut along the transverse direction;

FIGS. 3A and 3B are schematic diagrams of a differential signal transmission cable in comparative examples 1 and 2, wherein FIG. 3A is a schematic diagram showing a relationship between a tensile force T and a pressure P in the case that a binder tape is wound around an insulated electric wire having a circular cross section in a comparative example 1, and FIG. 3B is a schematic diagram showing a relationship between a tensile force T and a pressure P in the case that a binder tape is wound around an insulated electric wire having a cross section with curved portions and flat portions in a comparative example 2;

DETAILED DESCRIPTION OF THE PREFERRED EMBODIMENTS

Differential signal transmission cables in embodiments according to the present invention will be explained in more detail in conjunction with appended drawings.

Summary of the Embodiment

A differential signal transmission cable according an embodiment of the present invention comprises a pair of conductors arranged to be distant from each other and parallel to each other, an insulator covering the pair of conductors, the insulator having an outer periphery shape of a transversal cross section in that a plurality of curved lines with different curvature radiuses are combined, and a shield conductor wound around the insulator, the shield conductor having an inner periphery shape of a transversal cross section in that the plurality of curved lines are combined in accordance with the outer periphery shape of the insulator.

First Embodiment (Outline of a Structure of a Differential Signal Transmission Cable 1)

Figure 1:
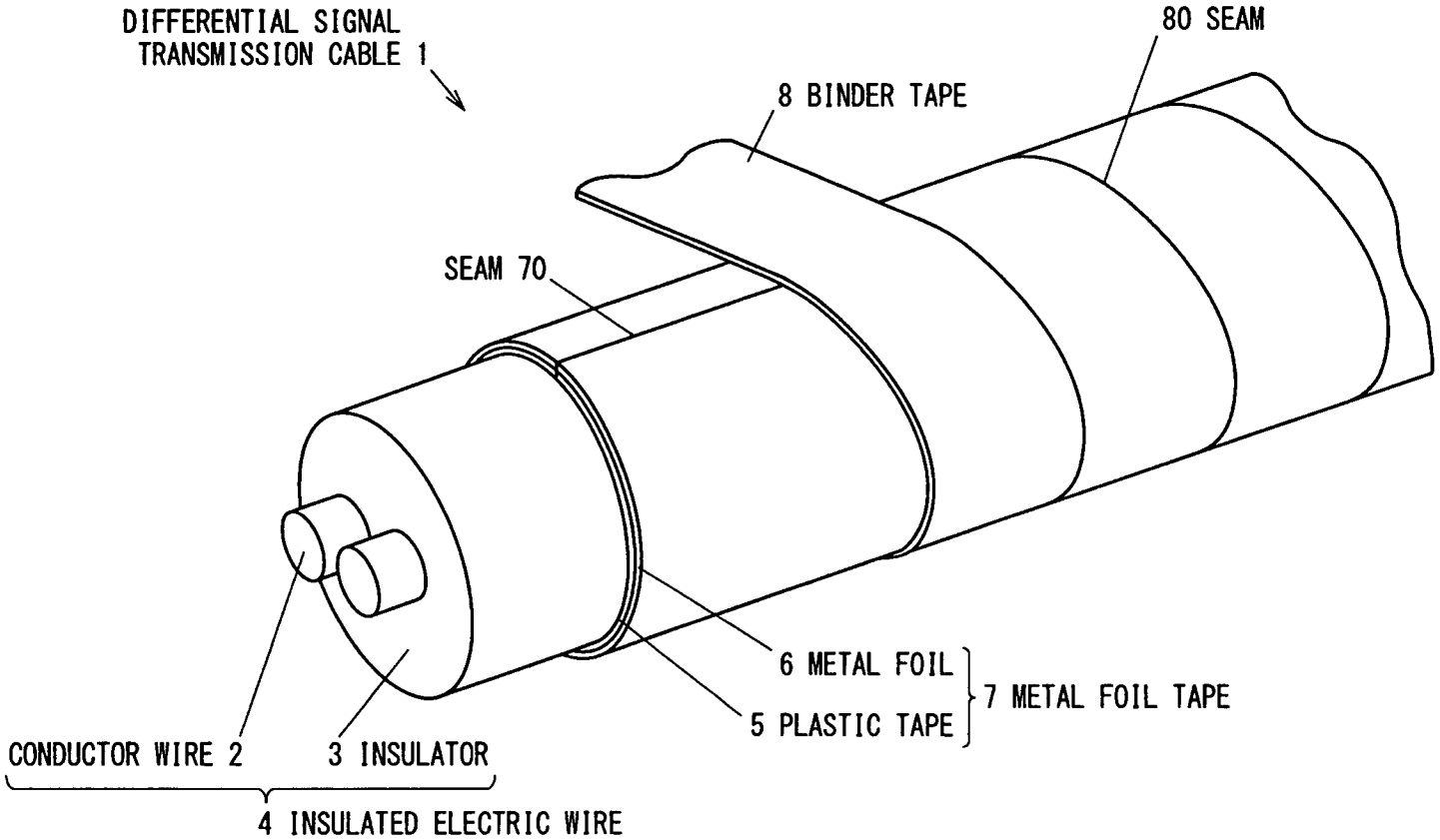
FIG. 1 is a perspective view of a differential signal transmission cable in the first embodiment.
Figure 2A:
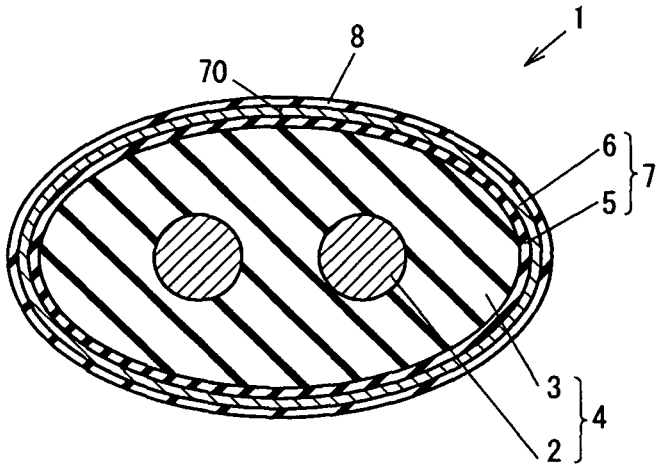
Figure 2B:
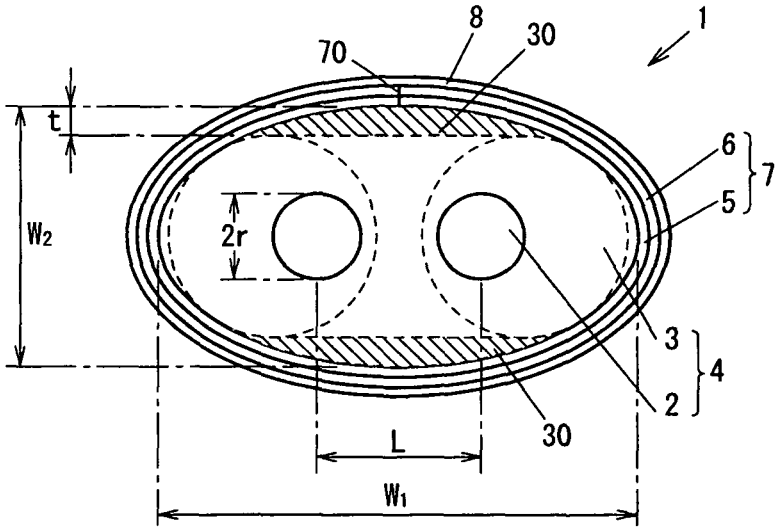

FIG. 1 is a perspective view of a differential signal transmission cable 1 in the first embodiment. FIG. 2A is a cross sectional view of the differential signal transmission cable taken along a transverse direction. FIG. 2B is a schematic diagram of a cross section of the differential signal transmission cable 1 cut along the transverse direction. In FIG. 2B, two circles indicated by dotted lines are shown for the descriptive purpose. The two circles illustrate transversal cross sectional shape of insulated electric wires to be used for making a cable having a transversal cross section similar to the differential signal transmission cable 1. In the following description, each cross section shows a cross section cut along the transverse direction unless described otherwise.

The differential signal transmission cable 1 is e.g. a cable for transmitting differential signals between or within electronic devices using differential signals of 10 Gbps or more such as server, router, and storage.

(Differential Signal Transmission)

The differential signal transmission (differential signaling) is to transmit two 180° out-of-phase signals through respective ones of a pair of conductor wires, and in a receiver side, a difference between the two 180° out-of-phase signals is taken out. Since electric currents transmitted through the pair of conductor wires are flown along directions opposite to each other, it is possible to reduce an electromagnetic wave emitted from the conductor wires as transmission paths for the electric current. Further, in the differential signal transmission, external noises are superimposed on the two conductor wires equally, so that it is possible to remove the external noise by taking the difference between the two 180° out-of-phase signals.

(Structure of the Differential Signal Transmission Cable 1)

For example, referring to FIG. 1, the differential signal transmission cable 1 according to the first embodiment comprises a pair of conductor wires (conductors) 2 arranged to be distant from each other and parallel to each other, an insulator 3 covering the pair of conductor wires 2, the insulator 3 having an outer periphery shape of a cross section along a transverse direction (i.e. transversal cross section) in that a plurality of curved lines with different curvature radiuses are combined, and a metal foil tape 7 as a shield conductor wound around the insulator 3, the metal foil tape having an inner periphery shape of a transversal cross section in that the plurality of curved lines are combined in accordance with the outer periphery shape of the insulator 3.

For example, the differential signal transmission cable 1 according to the first embodiment further comprises a binder tape 8 as a jacket member coating the metal foil tape 7, in which the metal foil tape 7 comprises a plastic tape 5 as an insulating member, and a metal foil 6 as an electrically conductive film (hereinafter, referred to as "conductive film") provided on the plastic tape 5 at a surface facing to the binder tape 8 (i.e. at an opposite surface to a surface facing to the insulator 3).

(The Conductor Wire 2)

The conductor wire 2 is e.g. a single wire having a good electrical conductivity such as copper or a single wire of this electric conductor which is plated or the like. A radius r of the conductor wire 2 is e.g. 0.511 mm. A spacing L between one conductor wire 2 and another conductor wire 2 is e.g. 0.99 mm. This spacing L is a distance between a center of one conductor wire 2 and a center of another conductor wire 2 in their cross sections. The conductor wire 2 may be e.g. a stranded wire formed by stranding a plurality of conductor wires when a flexural property is regarded to be important.

In an exemplary embodiment of the invention, a distance between the pair of conductors can be less than distances from the pair of conductors to the shield conductor.

The insulator 3 is formed by using e.g. a material with a small dielectric constant and a small dissipation factor. For example, polytetrafluoroethylene (PTFE), perfluoroalkoxy (PFA), polyethylene or the like may be used for such material. The insulator 3 may comprise a foamed insulating resin as a foam material so as to reduce the dielectric constant and the dissipation factor. For example, when the insulator 3 comprises a foamed insulating resin, the insulator 3 may be formed by a method of kneading a forming agent in a resin and controlling a foaming degree by a molding temperature, and a method of injecting a gas such as nitrogen into a resin by a molding pressure and foaming the resin at the time of releasing the pressure, or the like.

Referring to FIG. 2B, the insulator 3 has a substantially elliptical cross section, in which a width $W_1$ in a major axis direction is 2.8 mm and a width $W_2$ in a minor axis direction is 1.54 mm.

In addition, the insulator 3 comprises e.g. a region 30 (a region indicated by hatched portion) surrounded by a line connecting apexes of the two circles indicated by dotted lines in FIG. 2B and a part of an outer periphery of the insulator 3. For example, the circles indicated by dotted lines are circles internally touching the outer periphery of the cross section of the insulator 3. The region 30 shows a region which is not formed in an insulator for coating the two insulated electric wires shown by the two circles indicated by dotted lines in FIG. 2B. A maximum width t of this region 30 is e.g. 0.07 mm.

Next, the cross sectional shape of the insulator 3 will be explained in conjunction with a comparative example 1 and a comparative example 2.

Figure 3A:
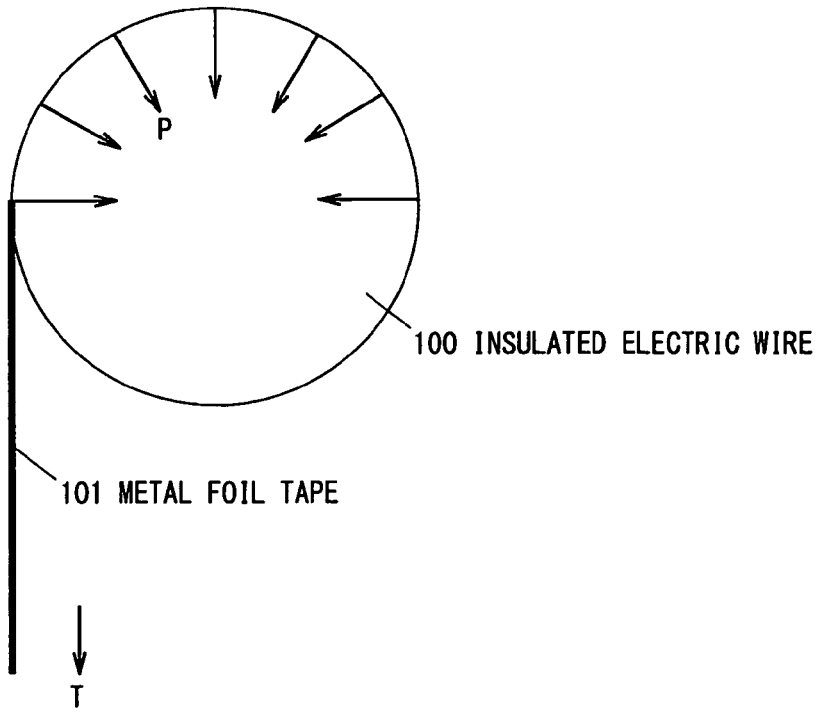
Figure 3B:
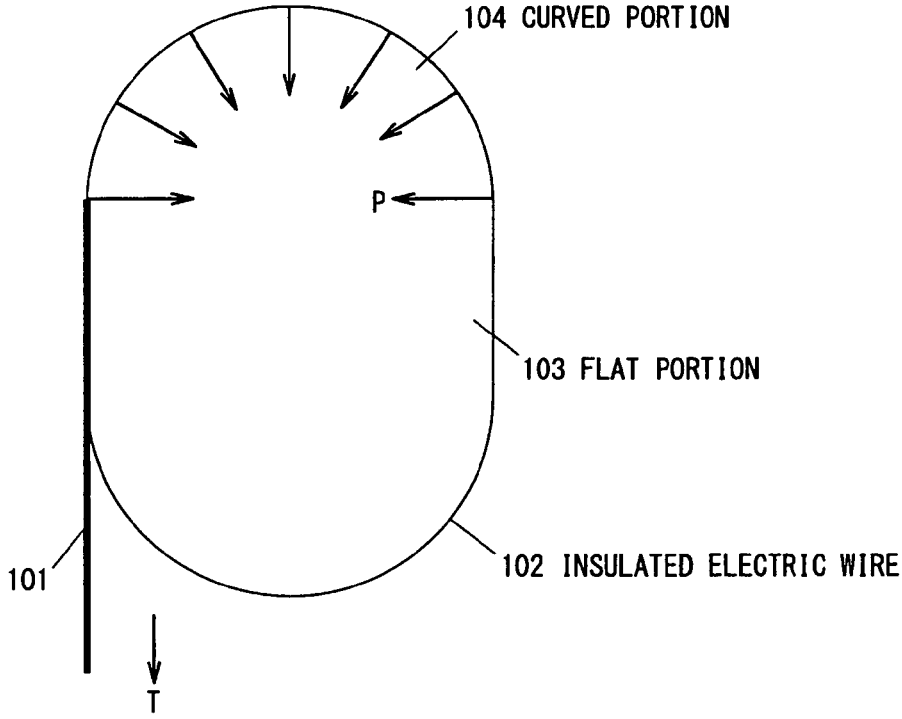

FIG. 3A is a schematic diagram showing a relationship between a tensile force T and a pressure P in the case that a binder tape is wound around an insulated electric wire having a circular cross section in the comparative example 1. FIG. 3B is a schematic diagram showing a relationship between a tensile force T and a pressure P in the case that a binder tape is wound around an insulated electric wire having a cross section with curved portions and flat portions in the comparative example 2.

Herein, in the differential signal transmission cable, it is necessary to reduce the skew in order to transmit high-speed signals of several Gbps. The "skew" means a time difference between arrival times of the differential signals (i.e. skew in a pair).

In the case that the cable is formed by using two insulated electric wire, the skew occurs due to a slight dielectric constant difference between the insulators, a slight outer diameter difference between the insulators, a little slippage of a drain wire attached along the longitudinal direction of the insulator, air gaps provided at an interface between the insulator and the metal foil tape due to the slack of the metal foil tape provided at an outer side of the insulator, and the like.

Further, in the differential signal transmission cable, it is necessary to suppress a differential mode to common mode conversion amount in order to suppress EMI (Electro-Magnetic Interference) to be low. Unless a symmetry (in lateral direction) of the cable is excellent, a part of input differential signals will be converted into an in-phase (common mode) signal. A proportion of the differential signals (differential mode signals) that are converted into the common mode signals is called as "differential mode to common mode conversion amount". In particular, the proportion of the common mode signal at a port 2 in response to a differential signal at a port 1 can be measured as S parameter and expressed as "Scd21".

As a method for reducing the skew, a method for coating two conductors with a single insulator, thereby suppressing the dielectric constant difference in the insulator, has been known. Alternatively, a method for winding an insulator tape around two insulated electric wires prior to coating the two insulated electric wires with a shield conductor, thereby relatively increasing a distance between the shield and the conductors, has been known. According to this structure, an electromagnetic coupling between the conductors is enhanced, so that it is possible to provide a cable in which the skew hardly occurs.

As to the aforementioned methods for reducing the skew, the effect on the skew due to the dielectric constant difference within the insulator is confirmed to some extent. It is possible to reduce the skew by providing a constant outer periphery shape of the insulator and by preventing the conductors from displacement, in addition to the aforementioned method.

However, even if the aforementioned method is carried out, the influence due to the air gaps generated from the slack of the metal foil tape wound around the insulator will slightly remain. For example, in the case that the differential signal transmission cable is used as a cable for high-speed signal transmission of around 10 Gbps, there is a disadvantage in that yield falls down due to the influence caused by the air gaps.

Such slack of the metal foil tape does occur in both of the case that the metal foil tape is wound around the insulator and the case that the binder tape is wound around the metal foil tape which wraps the conductor in the longitudinal direction.

As the possible causes of the slack of the wound metal foil tape, it is assumed that a force that the metal foil tape presses the insulator, i.e. the pressure P of the metal foil tape applied to the insulator is small.

Referring to FIG. 3A, a metal foil tape 101 is wound around an insulated electric wire 100 having a circular cross section in the comparative example 1. In the comparative example 1, a force acts on the insulated electric wire 100 such that the force balances a tensile force T of the metal foil tape 101.

This force functions as the pressure P applied to a side surface of the insulated electric wire 100. There is a relationship between the pressure P and the tensile force T expressed as follows:

$$P=T/(2wr_1),$$

wherein w is a width of the metal foil tape and $r_1$ is a radius of the insulated electric wire.

On the other hand, referring to FIG. 3B, in the comparative example 2, a metal foil tape 101 is wound around an insulated electric wire 102 having a cross section in which flat portions 103 and curved portions 104 are combined. In the comparative example 2, the pressure same as P (expressed as $P=T/(2wr_1)$) is applied to the curved portion 104. However, as to the flat portion 103, a direction of the tensile force T of the metal foil tape 101 is parallel with a plane made by a surface of the flat portion 103, so that the pressure P applied to the flat portion 103 based on the tensile force T is zero.

In both of the cross section in which two circular-shaped insulated electric wires are arranged and the cross section in which the flat portions 103 and the curved portions 104 are combined as shown in FIG. 3B, when the metal foil tape 101 is wound therearound, the cross section includes a portion that the metal foil tape 101 is straight.

In other words, for the case of the comparative example 2, when the metal foil tape 101 is wound, the direction of the tensile force T of the metal foil tape 101 is parallel to the plane made by the surface of the flat portion 103, so that the force does not act on the flat portion 103. In the flat portion 103, the slack of the metal foil tape 101 wound around the flat portion 103 may be caused by a slight movement of a differential signal transmission cable when the metal foil tape 101 is wound, a little variation in the tensile force T of the metal foil tape 101, and the like. As a result, the skew occurs and the differential mode to common mode conversion amount increases.

In accordance with the aforementioned result, the insulator 3 in the first embodiment comprises the regions 30 indicated by hatched portions in FIG. 2B at locations above and below the two circles in FIG. 2B. Accordingly, as to a vector of the pressure P generated by winding the metal foil tape 7, there is no region in which the direction of the tensile force T of the metal foil tape 7 is parallel to the plane made by the surface of the flat portion 103.

(The Metal Foil Tape 7)

The plastic tape 5 of the metal foil tape 7 may comprise e.g. a resin material such as polyethylene.

The metal foil 6 of the metal foil tape 7 is made by adhering copper or aluminum on one surface of the plastic tape 5.

In addition, the metal foil tape 7 comprises a seam or an overlapping region along a longitudinal direction of the insulator 3. For example, the metal foil tape 7 in the first embodiment is provided by so-called "cigarette wrapping" method to cover the insulator 3 of the insulated electric wire 4. The "cigarette wrapping" is a method for disposing the metal foil tape 7 along the longitudinal direction of the insulator 3, and wrapping the metal foil tape 7 once around the insulator 3 from a side surface in the longitudinal direction of the insulator 3. For example, one end and another end of the metal foil tape 7 abut to each other along the longitudinal direction of the metal foil tape 7, so that a seam 70 shown in FIG. 1 is formed along the longitudinal direction. Alternatively, when the metal foil tape 7 is longer than the outer periphery in the transverse direction of the insulator 3, one end overlaps with another end of the metal foil tape 7, so that the overlapping region is formed.

(The Binder Tape 8)

The binder tape 8 may comprise e.g. a resin material.

The binder tape 8 comprises a seam or an overlapping portion spirally around the metal foil tape 7. For example, the binder tape 8 in the first embodiment may be wound spirally for covering the metal foil tape 7. The binder tape 8 is wound around the insulator 3 such that one end and another end in the transverse direction do not overlap with each other. Therefore, a seam 80 shown in FIG. 1 is formed spirally around the metal foil tape 7. Alternatively, when the binder tape 8 is wound around the metal foil tape 7 such that one end overlaps with another end of the binder tape 8, an overlapping region will be provided spirally around the metal foil tape 7.

(Method for Manufacturing the Differential Signal Transmission Cable 1)

Next, a method for manufacturing the differential signal transmission cable 1 in the first embodiment will be explained below.

Firstly, a pair of conductor wires 2 are coated with one insulator 3 to provide an insulated electric wire 4. Specifically, two conductor wires 2 are arranged to be distant from each other and parallel with each other. For example, the pair of conductor wires 2 are arranged to be distant from each other with an interval of 0.99 mm and parallel with each other. A radius r of each of the conductor wires 2 is e.g. 0.511 mm. Expanded polyethylene (EPE) is used for coating the pair of conductor wires 2, so as to provide the insulator 3 around the conductor wires 2. Formation of the insulator 3 is carried out such that a relative permittivity of the insulator 3 becomes 1.5 by adjusting a foaming degree.

The insulator 3 has a cross sectional shape as shown in FIG. 2B in which a plurality of curves having curvature radiuses different from each other are combined. For example, a width $W_1$ in the major axis direction is 2.8 mm and a width $W_2$ in the minor axis direction is 1.54 mm. A maximum width t of the region 30 is e.g. 0.07 mm. A curvature radius of the region 30 located along the minor axis direction is e.g. 7 mm. A curvature radius of a curved portion located along the major axis direction is e.g. 0.7 mm.

The insulator 3 may be formed around the pair of conductor wires 2 by e.g. extruding polyethylene simultaneously with the pair of conductor wires 2 from a extruding nozzle of an extruder, and a shape of the extruding nozzle is determined based on a desired shape of the insulator 3. As a result, an insulated electric wire 4 comprising the pair of conductor wires 2 and the insulator 3 surrounding the pair of conductor wires 2 is provided.

Next, a metal foil tape 7 is disposed along the longitudinal direction of the insulated electric wire 4, and the insulated electric wire 4 is wrapped by the metal foil tape 7. This wrapping is carried out such that one surface on which a plastic tape 5 is provided contacts to the insulator 3, while another surface on which a metal foil 6 is provided is exposed outwardly. Herein, the metal foil 6 is exposed outwardly since soldering process will be carried out later.

Successively, a binder tape 8 is wound spirally around the metal foil tape 7. Thereafter, several processes are carried out to provide a differential signal transmission cable 1.

(Relationship Between the Curvature Radius and the Slack of Metal Foil Tape 7)

Figure 4:
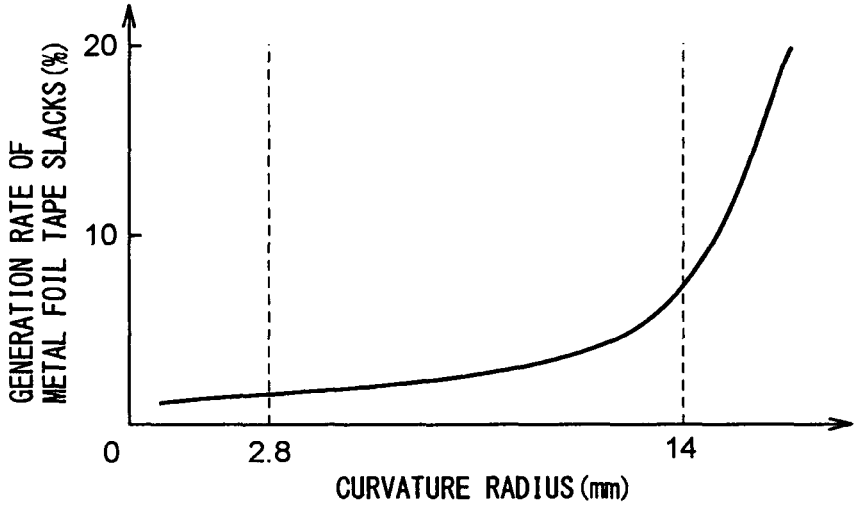
FIG. 4 is a graph showing a relationship between a curvature radius and a generation rate of slacks in the metal foil tape in the differential signal transmission cable in the first embodiment.

FIG. 4 is a graph showing a relationship between a curvature radius and a generation rate of slacks in the metal foil tape in the differential signal transmission cable in the first embodiment. In FIG. 4, a horizontal axis shows a curvature radius of the region 30 of the insulator 3, and a vertical axis shows a generation rate of slacks in the metal foil tape 7 in the differential signal transmission cable 1. The generation rate of the slacks in this metal foil tape 7 means a rate of generation of an air gap (clearance) between the insulator 3 and the metal foil tape 7 in a certain cross section of the cable in the entire manufactured cable.

Measurement of the generation rate of the slacks in the metal foil tape 7 is carried out by a method as explained below. Firstly, cable samples are collected equitably from the manufactured cable along its entire length. Then, a cross section of each cable sample is observed. In each cable sample, the presence of air gap (i.e. as to whether or not the air gap exists) between insulator 3 and the metal foil tape 7 is observed. A ratio of the number of the cable samples in which the air gap is observed to the number of all cable samples is determined as the generation rate of the slacks in the metal foil tape 7.

It can be clearly understood from a measurement result shown in this FIG. 4 that when a curvature radius of the region 30 of the insulator 3 is not greater than 14 mm (i.e. 20 times greater than a curvature radius of 0.7 mm of a curved portion located in the major axis direction), the generation rate of the slacks in the metal foil tape 7 is several % or less, so that it is possible to maintain the properties of differential signal transmission cable 1, such as the low skew and the low differential mode to common mode conversion amount.

On the other hand, when the curvature radius of the region 30 of the insulator 3 is 2.8 mm (i.e. 4 times greater than the curvature radius of 0.7 mm of the curved portion located in the major axis direction) or less, the generation rate of the slacks in the metal foil tape 7 can be reduced. However, the thickness t of the region 30 is increased to 0.25 mm or more. Due to the increase in thickness, characteristic impedance of the differential signal transmission cable 1 is increased. In addition, an outer diameter of a stranded cable comprising a plurality of differential signal transmission cables 1 that are stranded together is increased, when each differential signal transmission cable 1 comprises the region 30 having a the curvature radius of 2.8 mm or less, so that it is difficult to handle such stranded cable. Therefore, it is preferable that a range of the curvature radius of the region 30 (i.e. the portion in the minor axis direction) is from 4 times to 20 times greater than the curvature radius of the portion in the major axis direction.

Effect of the First Embodiment

According to the differential signal transmission cable 1 in the first embodiment, it is possible to suppress the skew and the differential mode to common mode conversion amount. Specifically, referring to FIG. 2B, the outer periphery of the cross section of the insulator 3 of the differential signal transmission cable 1 is formed by combining a plurality of curves having curvature radiuses different from each other, i.e. the combination of the region 30 located along the minor axis direction with the curvature radius of 7 mm, and the curved portion located along the major axis direction with the curvature radius of 0.7 mm.

Accordingly, in the differential signal transmission cable 1, when the binder tape 8 is wound around the insulated electric wire 4, the pressure P is always applied to the surface of the insulator 3 to balance the tensile force T of the metal foil tape 7. It is assumed that the pressure P is inversely proportional to the curvature radius of the outer periphery of the cross section of the insulator 3 when the tensile force T of the metal foil tape 7 is constant. Therefore, the pressure P in the region 30 is reduced to about 1/10 of the pressure in the portion along the major axis direction. If the region 30 is not formed in the insulator 3, the pressure P will not be applied to the insulator 3 at the straight portion.

Further, since the region 30 is formed in the insulator 3 in the present embodiment, the pressure P is always applied to the insulator 3. Therefore, even though the insulated electric wire 4 is shifted or the tensile force T of the binder tape 8 is weaker than a predetermined tensile force when the metal foil tape 7 is wound around the insulator 3, it is possible to suppress the generation of slack of the binder tape 8. Therefore, it is possible to suppress the slack of the metal foil tape 7, so that it is possible to suppress the formation of air gaps at the interface between the insulator 3 and the metal foil tape 7. According to the differential signal transmission cable 1 in the first embodiment, it is possible to suppress the deterioration in performance due to the increase in the skew and differential mode to common mode conversion amount.

Second Embodiment

A differential signal transmission cable in the second embodiment is similar to that in first embodiment except that an outer periphery shape of a transversal cross section of the insulator 3 is elliptical.

Figure 5A:
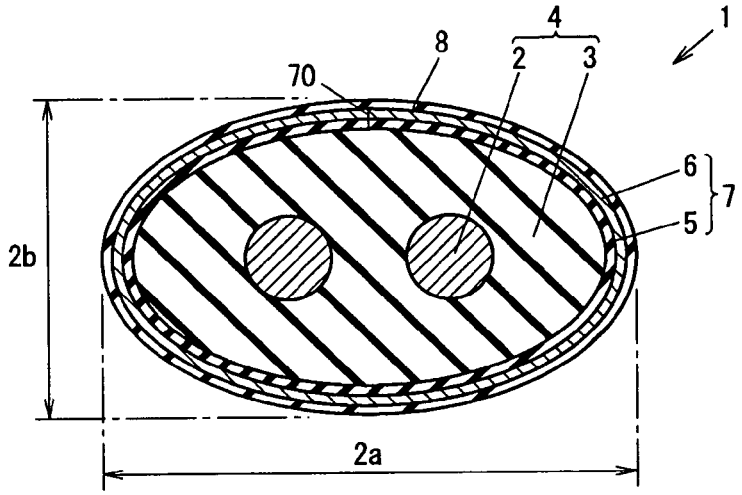
FIG. 5A is a cross section view in a transverse direction of a differential signal transmission cable in the second embodiment.
Figure 5B:
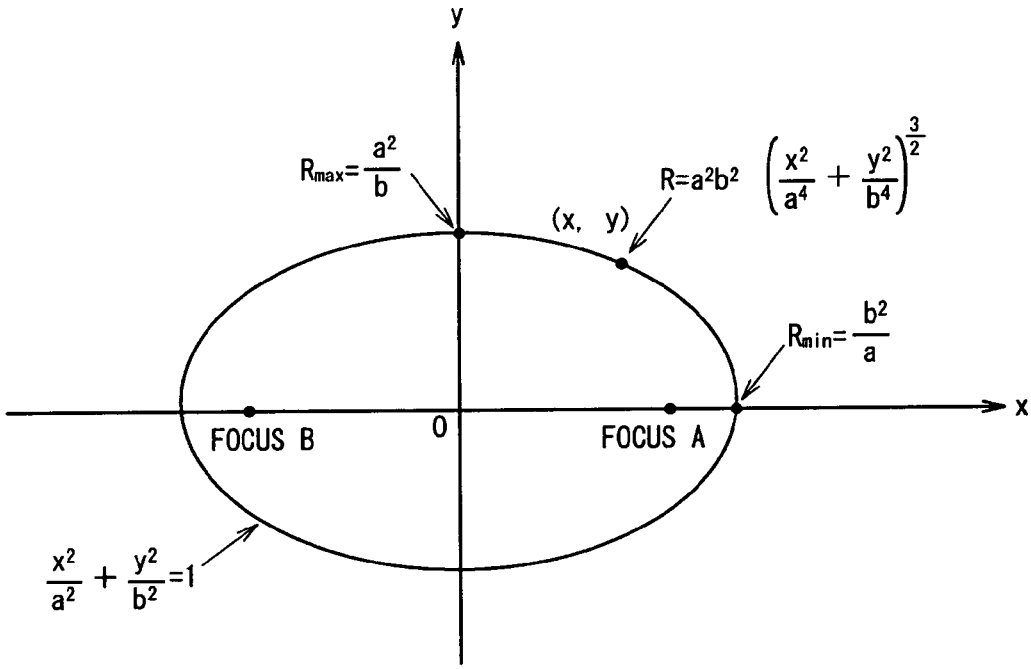
FIG. 5B is graph showing a maximum value and a minimum value of the curvature radius.

FIG. 5A is a cross section view in a transverse direction of a differential signal transmission cable 1 in the second embodiment. FIG. 5B is graph showing a maximum value and a minimum value of the curvature radius of an outer periphery of an elliptical cross section of the insulator 3. In FIG. 5B, a horizontal axis shows an x-axis and a vertical axis shows a y-axis of the elliptical cross section of the insulator 3. In this elliptic, a major axis is on the x-axis and a minor axis is on the y-axis. In following embodiments, the same reference numerals as those in the first embodiment are used for indicating elements having the same structure and function as those in the first embodiment, and the description thereof is omitted.

In the differential signal transmission cable 1 in the second embodiment, the outer periphery shape of the insulator 3 is an elliptic having a focus A and a focus B. As to other structures, the differential signal transmission cable 1 in the second embodiment is similar to the differential signal transmission cable 1 in the first embodiment.

A method for manufacturing the differential signal transmission cable 1 in the present embodiment is different from the first embodiment in that the insulator 3 having an elliptical shape with the major axis (=2*a*) of 3.20 mm and the minor axis (=2*b*) of 1.64 mm is formed.

In the differential signal transmission cable 1 in the second embodiment, when the binder tape 8 is wound around the metal foil tape 7, the pressure P is always applied to the surface of the insulator 3. A vector of the pressure P which is applied to the insulator 3 by the metal foil tape 7 is directed toward either of the focus A and the focus B shown in FIG. 5B.

As described above, the pressure P is inversely proportional to the curvature radius of the outer periphery of the cross section of the insulator 3 when the tensile force T of the metal foil tape 7 is constant. As shown in FIG. 5B, Equation (1) expresses an elliptic with a major axis 2*a* and a minor axis 2*b*, and Equation (2) expresses a curvature radius R at an arbitrary point (x, y) on an elliptical curve of this elliptic.

[Equation 1]

$$\frac{x^2}{a^2} + \frac{y^2}{b^2} = 1 \tag{1}$$

[Equation 2]

$$R = a^2 b^2 \left( \frac{x^2}{a^4} + \frac{y^2}{b^4} \right)^{\frac{3}{2}} \tag{2}$$

From the Equation (2), it is understood that the curvature radius R varies within a range from $b^2/a$ to $a^2/b$ (i.e. $b^2/a \le R \le a^2/b$). Therefore, a minimum value of the pressure P is $(b/a)^3$ of a maximum value of the pressure P. According, in the cross sectional shape of the insulator 3 in the second embodiment, the pressure P on the minor axis is reduced to about 13% of the pressure P on the major axis.

In other words, a ratio of the minimum value to the maximum value of the curvature radius R is $(b/a)^3$. Similarly to the first embodiment, it is preferable that a range of the ratio of the minimum value to the maximum value of the curvature radius R is from 1/20 to 1/4 (i.e. $0.05 \le (b/a)^3 \le 0.25$). In other words, the minimum value of the curvature radius R is preferably from 1/20 to 1/4 of the maximum value of the curvature radius R. Therefore, if the minor axis 2*b* of the cross section of the insulator 3 is about 0.37 times or more of the major axis 2*a* and 0.63 times or less of the major axis 2*b*, the minimum value of the curvature radius R will be from 1/20 to 1/4 of the maximum value of the curvature radius R.

When the ratio of the minimum value to the maximum value of the curvature radius R falls within the aforementioned range, it is possible to suppress the slack of the metal foil tape 7 similarly to the first embodiment.

Effect of the Second Embodiment

However, according to the differential signal transmission cable 1 in the second embodiment, the metal foil tape 7 can be wound such that the pressure is always applied to the insulator 3 similarly to the first embodiment. Therefore, even though the insulated electric wire 4 is shifted or the tensile force T of the binder tape 8 is weaker than a predetermined tensile force when the metal foil tape 7 is wound around the insulator 3, it is possible to suppress the generation of slack of the binder tape 8.

As a result, it is possible to suppress the slack of the metal foil tape 7, so that it is possible to suppress the formation of air gaps at the interface between the insulator 3 and the metal foil tape 7. In addition, since the curvature radius does not vary suddenly in comparison with the first embodiment, a generation rate of the air gaps (clearances) can be further reduced. According to the differential signal transmission cable 1 in the second embodiment, it is possible to suppress the deterioration in performance due to the skew and the increase in differential mode to common mode conversion amount.

The Third Embodiment

A differential signal transmission cable in the third embodiment is similar to that in the first and second embodiments except that a foaming degree of an inner portion of the insulator 3 is different from that of an outer periphery portion of the insulator 3.

Figure 6:
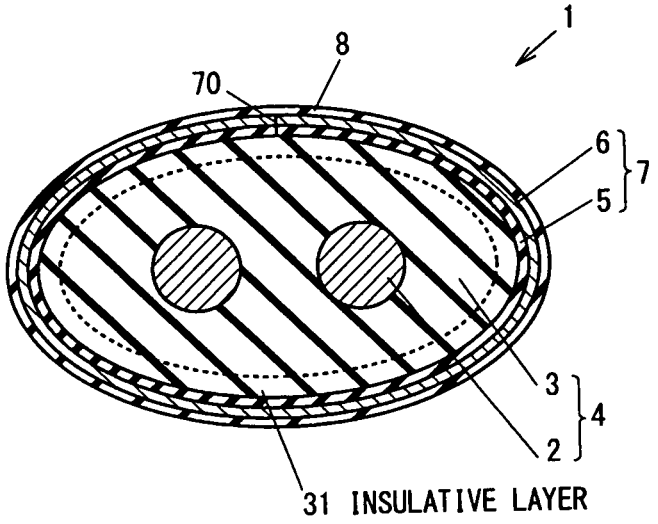
FIG. 6 is a cross sectional view in a transverse direction of a differential signal transmission cable in the third embodiment.

FIG. 6 is a cross sectional view in a transverse direction of a differential signal transmission cable 1 in the third embodiment. In FIG. 6, a region surrounded by an outer periphery and a dotted line of the insulator 3 is an insulative layer 31.

In the differential signal transmission cable 1 in the third embodiment, the foaming degree of the inner portion and the foaming degree of the outer periphery portion are different from each other. As to other structure, the differential signal transmission cable 1 in the third embodiment is similar to the differential signal transmission cable 1 in the first embodiment. For example, the foaming degree of the inner portion (i.e. a portion of the insulator 3 interior to the insulative layer 31) is 50% as an example, and the foaming degree of the insulative layer 31 is several %.

The foaming degree of the insulative layer 31 of the insulator 3 is smaller than the foaming degree of the inner portion of the insulator 3. Namely, in the insulator 3, the outer periphery portion is harder than the inner portion since the insulative layer 31 is formed at the outer periphery of the insulator 3.

A method for manufacturing the differential signal transmission cable 1 in the third embodiment is similar to the first and second embodiments except following point. Namely, after the pair of the conductor wires 2 are coated with a first foamed resin material by using of the extruder, a second foamed resin material having the foaming degree smaller than the first foamed resin material is extruded as an outermost layer of the insulator 3 to re-coat the first formed resin, thereby providing the insulative layer 31. The other processes are similar to those in the first and second embodiments.

Effect of the Third Embodiment

According to the differential signal transmission cable 1 in the third embodiment, since the insulative layer 31 is formed at the outer periphery portion, the shape of the insulator 3 is more stable than those in the first and second embodiments, so that the pressure P applied from the binder tape 8 acts on the insulator 3 more stably. As a result, it is possible to suppress the slack of the metal foil tape 7, so that it is possible to suppress the formation of air gaps at the interface between the insulator 3 and the metal foil tape 7. According to the differential signal transmission cable 1 in the third embodiment, it is possible to suppress the deterioration in performance due to the skew and the increase in differential mode to common mode conversion amount.

(Variation)

Figure 7:
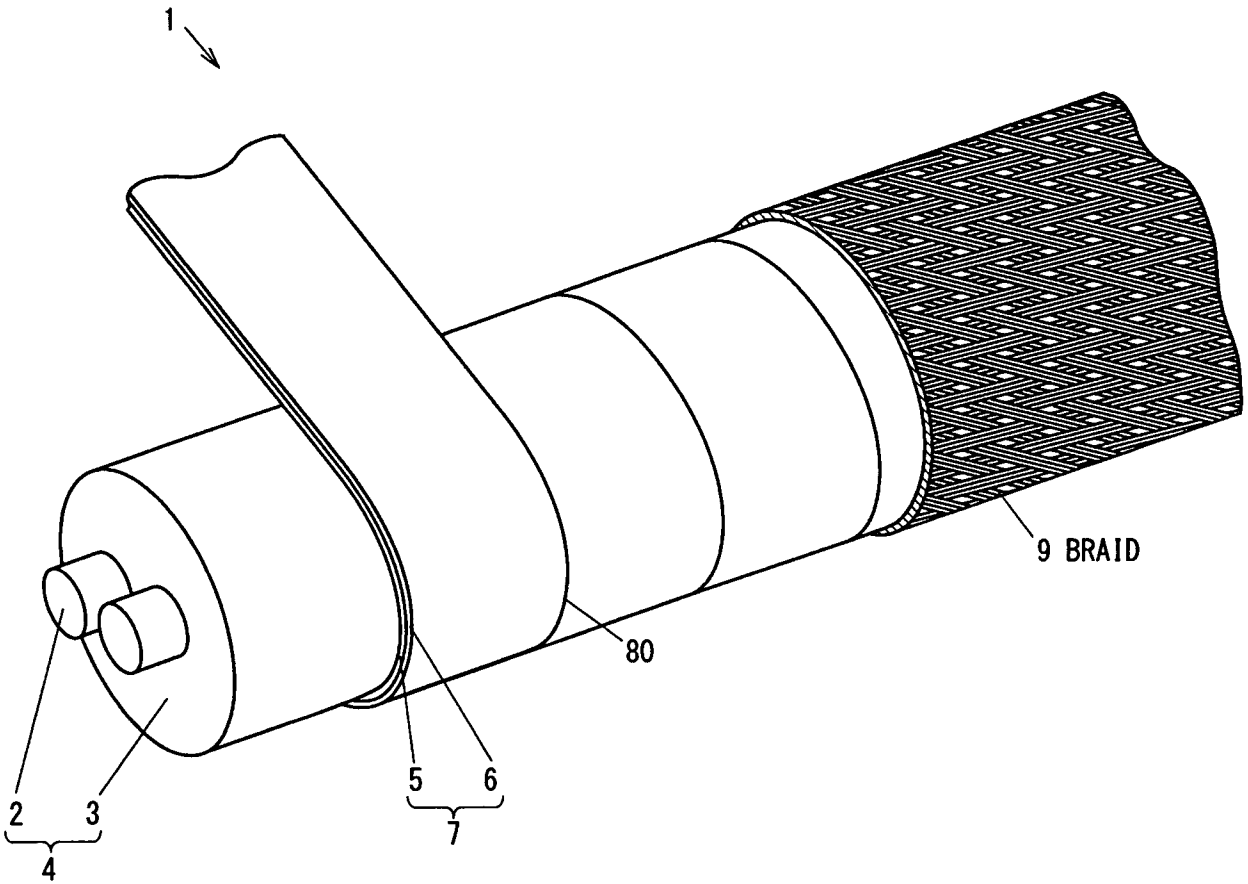
FIG. 7 is a perspective view of a differential signal transmission cable in a variation of the present invention.

FIG. 7 is a perspective view of a differential signal transmission cable 1 in a variation of the present invention. In the differential signal transmission cable 1 in the variation, a metal foil tape 7 comprises a seam 80 provided spirally around the insulator 3, and a jacket member for coating the metal foil tape 7 is a braid 9. The metal foil tape 7 is made by adhering copper on one surface of a plastic tape 5. The braid 9 is formed by braiding sixty-four (64) copper wires each of which has a diameter of 0.08 mm.

Alternatively, the metal foil tape 7 may comprise an overlapping region spirally on the insulator 3.

(Effect of the Variation)

Since the differential signal transmission cable 1 in the variation comprises the insulator 3 having the shape of either of the first to third embodiments, even though the metal foil tape 7 is wound spirally around the insulator 3, it is possible to suppress the slack of the metal foil tape 7. As a result, it is possible to suppress the formation of air gaps at the interface between the insulator 3 and the metal foil tape 7. According to the differential signal transmission cable 1 in the variation, it is possible to suppress the deterioration in performance due to the skew and the increase in differential mode to common mode conversion amount.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A differential signal transmission cable comprising:

a pair of conductors arranged to be distant from each other and parallel to each other;

an insulator covering the pair of conductors, the insulator having an outer periphery shape of a transversal cross section in that a plurality of curved lines with different curvature radiuses are combined; and a shield conductor wound around the insulator, the shield conductor having an inner periphery shape of a transversal cross section in that the plurality of curved lines are combined in accordance with the outer periphery shape of the insulator, wherein the shield conductor comprises a seam or an overlapping region along a longitudinal direction of the insulator.

2. The differential signal transmission cable according to claim 1, wherein a minimum value of the curvature radiuses of the plurality of curved lines is 1/20 or more and 1/4 or less of a maximum value of the curvature radiuses of the plurality of curved lines.

3. The differential signal transmission cable according to claim 2, wherein the outer periphery shape of the transversal cross section of the insulator comprises an elliptical shape, and a minor axis of the transversal cross section is preferably 0.37 times or more and 0.63 times or less of a major axis of the transversal cross section.

4. The differential signal transmission cable according to claim 1, further comprising:

a jacket member coating the shield conductor, wherein the shield conductor comprises an insulating member and an electrically conductive film provided on the insulating member at a surface facing to the jacket member.

5. The differential signal transmission cable according to claim 4, wherein the shield conductor comprises a seam or an overlapping region along a longitudinal direction of the insulator, and the jacket member comprises a seam or an overlapping region spirally on the shield conductor.

6. The differential signal transmission cable according to claim 4, wherein the shield conductor comprises a seam or an overlapping region on the insulator, and the jacket member comprises a braid.

7. The differential signal transmission cable according to claim 1, wherein the insulator comprises a foam material.

8. The differential signal transmission cable according to claim 7, wherein the insulator comprises an outer layer having a foaming degree smaller than a foaming degree of a portion interior to the outer layer.

9. The differential signal transmission cable according to claim 1, wherein the shield conductor continuously contacts an outer periphery of the insulator at the transversal cross section thereof.

10. The differential signal transmission cable according to claim 1, wherein the shield conductor is disposed on the insulator such that air gaps between the shield conductor and insulator are absent.

11. A differential signal transmission cable comprising:

a pair of conductors arranged to be distant from each other and parallel to each other;

an insulator covering the pair of conductors, the insulator having an outer periphery shape of a transversal cross section in that a plurality of curved lines with different curvature radiuses are combined; and a shield conductor wound around the insulator, the shield conductor having an inner periphery shape of a transversal cross section in that the plurality of curved lines are combined in accordance with the outer periphery shape of the insulator, wherein a drain wire is absent from the differential signal transmission cable.

12. The differential signal transmission cable according to claim 11, wherein the insulator is continuous within the outer periphery shape thereof except for the pair of conductors.

13. The differential signal transmission cable according to claim 11, wherein the shield conductor comprises a seam or an overlapping region along a longitudinal direction of the insulator.

14. The differential signal transmission cable according to claim 11, further comprising:

a jacket member coating the shield conductor, wherein a drain wire is absent within the jacket member.

15. The differential signal transmission cable according to claim 11, wherein the shield conductor continuously contacts an outer periphery of the insulator at the transversal cross section thereof.

16. A differential signal transmission cable comprising:

a pair of conductors arranged to be distant from each other and parallel to each other;

an insulator covering the pair of conductors, the insulator having an outer periphery shape of a transversal cross section in that a plurality of curved lines with different curvature radiuses are combined; and a shield conductor wound around the insulator, the shield conductor having an inner periphery shape of a transversal cross section in that the plurality of curved lines are combined in accordance with the outer periphery shape of the insulator, wherein a distance between the pair of conductors is less than distances from the pair of conductors to the shield conductor.

17. The differential signal transmission cable according to claim 16, wherein the distances from the pair of conductors to the shield conductor are measured along a plane passing through the pair of conductors.

18. The differential signal transmission cable according to claim 16, wherein the pair of conductors and the shield conductor are configured so as to allow differential signals of 10 Gbs.

19. The differential signal transmission cable according to claim 16, wherein the shield conductor continuously contacts an outer periphery of the insulator at the transversal cross section.

20. The differential signal transmission cable according to claim 16, wherein the shield conductor is under tension so as to apply a normal force around an entire circumference thereof.

* * * * *